US006016812A

United States Patent [19]

Guynn

[11] Patent Number: 6,016,812

[45] Date of Patent: Jan. 25, 2000

[54] APPARATUS AND SYSTEMS FOR CLEANING UNDER A PERSON'S FINGERNAILS

[75] Inventor: John M. Guynn, 1465 E. Princeton Ave., Salt Lake City, Utah 84105

[73] Assignee: John M. Guynn, Salt Lake City, Utah

[21] Appl. No.: 09/205,139

[22] Filed: Dec. 3, 1998

[51] Int. Cl.[7] ..... A45D 29/18

[52] U.S. Cl. ..... 132/74.5; 132/73; 132/73.6; 15/97.1; 15/21.1

[58] Field of Search ..... 132/73, 73.5, 75, 132/75.3, 76.4, 74.5, 73.6; 15/97.1, 21.1, 104.92, 167.3; 401/122, 219

[56] References Cited

U.S. PATENT DOCUMENTS

| | | | |
|---|---|---|---|
| 2,223,204 | 11/1940 | Carmichael | 132/73.5 |
| 3,066,336 | 12/1962 | Stobbe | 15/21 |
| 3,966,335 | 6/1976 | Abramson | 401/196 |
| 4,130,908 | 12/1978 | Alcamo | 15/21 |
| 4,137,929 | 2/1979 | Grossman | 134/182 |
| 4,296,766 | 10/1981 | Benis | 132/73 |
| 4,397,324 | 8/1983 | Thomas, Jr. | 132/73.5 |
| 4,510,954 | 4/1985 | Miller | 132/75 |
| 4,564,968 | 1/1986 | Buckley | 15/21 |
| 4,646,953 | 3/1987 | Marshall et al. | 132/73 |
| 4,915,331 | 4/1990 | Becker et al. | 132/73 |
| 5,027,839 | 7/1991 | Appell | 132/285 |
| 5,500,971 | 3/1996 | Springmann | 15/23 |
| 5,769,099 | 6/1998 | Davis et al. | 132/73.6 |
| 5,855,212 | 1/1999 | Walker | 132/73.5 |

*Primary Examiner*—Gene Mancene
*Assistant Examiner*—Pedro Philogene
*Attorney, Agent, or Firm*—Workman, Nydegger & Seeley; John M. Guynn, Esq.

[57] ABSTRACT

Apparatus and systems for use in cleaning the gap or crevice under a person's fingernails. The inventive apparatus includes one or more finger alignment guides which assist in maintaining the fingers in a desired orientation and a mechanical scrubber, such as a brush, individual strands, or a set of water jets, which are able to mechanically remove dirt and other foreign debris from the gap under a person's fingernails. The cleaning system further includes a cleaning liquid, such as an aqueous solution or other solvent-based liquid or solution that is able to assist the mechanical scrubber in removing foreign debris from under the fingernails. The alignment guide may be stationary while movement of the mechanical scrubber provides the scrubbing action. The mechanical scrubber will typically be driven by a motor or pump. Alternatively the fingers may move relative to the scrubber in order to provide the scrubbing action.

23 Claims, 4 Drawing Sheets

APPARATUS AND SYSTEMS FOR CLEANING UNDER A PERSON'S FINGERNAILS

BACKGROUND OF THE INVENTION

1. The Field of the Invention

The present invention relates to apparatus and systems for cleaning under a person's fingernails. More specifically, the present invention relates to apparatus and methods for mechanically and/or chemically cleaning dirt, grease or other foreign materials that may be lodged within the gap or crevice under a person's fingernails.

2. The Relevant Technology

In this modern world we are constantly being judged by our appearance. Whether it is our personality, intelligence, wit, or good demeanor we want to emphasize and be judged by, personal hygiene seems to play an even bigger role than ever before notwithstanding our other traits. Today, hard work and industry are not enough for a man to impress others. Gone are the days of old when a man could come home to his wife after a hard day's work, smelling of foul odors and being covered from head to toe in dirt, with no negative repercussion. Instead, we live in a highly sanitized and glamorized society in which images of finely dressed and well coifed models are continuously being thrust into our view as well as our collective psyche.

In the interplay between individuals, especially in the often competitive world of dating, romance, and career advancement, one of the first things that people notice and form impressions from is the cleanliness (or lack thereof) of another's fingernails. When I speak of cleanliness of fingernails, I refer not so much to the outer surface of the fingernail but rather to the gap or crevice between the tips of the fingernails and the underlying skin of the fingertip. Much about an individual can supposedly be divined based on the relative cleanliness of the individual's fingernails, such as one's perceived social class, vocation, hygienic habits, intelligence, and manners, not to mention recent activities. In general, the dirtier the fingernails, the more negative will be the assessment of an individual. The only time when dirty fingernails might be called for is when a project foreman wants to know how hard a particular worker has been working. Among the working classes a man might be adjudged to be effeminate if he is too fastidious about cleaning his fingernails.

For thousands of years people have been fighting dirty fingernails much like they hunted wild game in cave-man days—manually, with the blade of a knife. While this may work in some cases, such as where the dirt is easily dislodged, it presupposes a certain level of coordination while handling a knife. Once again, today's modern man is both better educated and less adept with a knife. For today's man, there are brushes that can be manually manipulated to scrub and clean the gap under the fingernails. Nevertheless, the brushing action requires at least a minimal amount of coordination and a high amount of concentration and patience due to the tendency of the brush to slip out of proper alignment with the fingernails. The hassle of cleaning dirt or grease from underneath the fingernails, coupled with the tendency of dirt to simply fall or be pushed out over time, has led many to simply ignore the problem, or even live in shame for a day or two with dirty fingernails.

Sadly, many a man who imagined himself a landscape artist or handy mechanic by day has suffered rejection and ridicule by the woman (or man) in his life by night when it came time to put on the evening clothes in preparation for a night out on the town. The unsightly and unmanicured look of "grease monkey hands" has put a damper on more than a few formal evenings. Regardless of a man's (or woman's) true social status, there have been many anxious moments as dirty fingernails were surreptitiously hidden in order to avoid their attendant negative social implications, only to rear their ugly heads at inopportune moments.

While scrubbing machines have been developed for the hands and fingers in general, such machines have been too crude and nonspecific to provide cleaning of the most difficult place to reach—the gap or crevice under the fingernails. For example, the following patents describe scrubbing machines that have some kind of mechanical brushing action to cleanse the hands and, in some cases, the fingers of an individual: U.S. Pat. No. 5,500,971 to Springmann; U.S. Pat. No. 4,564,968 to Buckley; U.S. Pat. No. 4,397,324 to Thomas, Jr.; U.S. Pat. No. 4,130,908 to Alcamo; and U.S. Pat. No. 3.066,336 to Stobbe. Whereas each of the foregoing patents discloses some mode of automatically cleaning a person's hands and/or fingers by automated brushing, none teaches or even suggests that the various apparatus disclosed in the foregoing patents have any utility for cleaning in the gap under a person's fingernails. Thoroughly cleaning one's hands while leaving an unsightly line of dirt under the fingernails will only serve to highlight the problem of dirty fingernails.

In light of the foregoing, what are needed are apparatus and methods for cleaning the gaps under a persons fingernails that alleviated the foregoing difficulties.

More specifically, what are needed are apparatus and methods for cleaning fingernails that provided a more precise and well-focused scrubbing action compared to manual brushes.

In addition, what are needed are apparatus and methods that allowed one to obtain clean under the fingernails in a far shorter time frame compared to manual procedures.

Further, what are needed are apparatus and methods that provided fast and reliable cleaning under one's fingernails while minimizing effort and concentration on the part of the user.

Such apparatus and methods for cleaning a person's fingernails are disclosed and claimed herein.

SUMMARY AND OBJECTS OF THE INVENTION

The present invention relates to apparatus and systems for cleaning underneath a person's fingernails. The inventive apparatus includes brushes or other scrubbing means that are able to mechanically scrub dirt and other foreign materials from within the gap or crevice underneath a person's fingernails. The system further includes a cleaning liquid or solution that is used in combination with the cleaning apparatus. A finger alignment guide or alignment means maintains the fingers in a generally parallel orientation relative to the plane of motion of the brush bristles or other scrubbing means in order for the cleaning action to remain reliably focused at the gap between the fingernail and finger where foreign debris tends to accumulate. This allows for greater ease and comfort with far less concentration and frustration when cleaning under the fingernails compared to manually held brushes or pocket knives used to clean under the nails.

In a preferred embodiment, some type of brush or brush-like configuration of bristles or like mechanical features are employed which mechanically reach under the fingernails in order to effect a scrubbing action. The bristles may be attached to a circular brush that rotates in one direction around an axis, or which oscillates back and forth. In the case where the brush oscillates back and forth around an axis, the brush bristles may be oriented in a semi-circle arc. Alternatively, the bristles may be attached to a straight or curved brush that oscillates from side-to-side, or which moves from side-to-side coupled with curved motion. In fact, any brush or brush-like configuration of bristles or similar strand-like devices can be used to clean under the nails. Fine jets of water, aqueous solutions or other cleaning liquids that are caused to pulsate, move back and forth or around in a circular motion can be used to mechanically and/or chemically remove debris from under the fingernails and constitute scrubbing means.

The main difficulty when using manually operated cleaning apparatus, such as conventional brushes, is the relative difficulty involved in focusing the scrubbing action where it is needed without the brush slipping off or otherwise failing to focus maximum scrubbing action underneath the fingernails. In fact, a fair degree of concentration is often required in order to achieve complete or even substantial cleaning under the fingernail. Thus, cleaning under one's fingernails can often be a frustrating experience.

One of the most important features of the present invention is the finger alignment means which, when used in conjunction with the scrubbing means, ensures that the scrubbing action is substantially focused in the correct plane or zone in order to maximize the scrubbing action. This, in turn, provides maximum cleaning in a minimum amount of time. Of equal or greater importance, the finger alignment means greatly reduces the effort and concentration required to otherwise keep the fingers and scrubbing action properly aligned in order to result in effective cleaning under the nails.

The finger alignment means may comprise any mechanism by which the fingers are maintain in a proper orientation relative to the scrubbing action. In general, the motion of the bristles or other scrubbing means will define a plane or other appropriately shaped scrubbing zone depending on the exact motion of the bristles. Maximum cleaning action will occur when the plane defined by the fingernail being cleaned is substantially parallel to the plane of the scrubbing action. In this configuration, the tips of the brush bristles or other scrubbing means can most easily reach into the gap under the fingernail. Of course, varying degrees of cleaning may still occur within a range of angles above or below exact alignment of the fingernail plane and the scrubbing action plane. The present invention certainly includes any orientation of the fingernails relative to the scrubbing zone that nevertheless allows adequate access of the bristles or other scrubbing means within the gap under the fingernail in order to effect adequate removal of dirt and debris therefrom.

By way of example, the finger alignment means may comprise a platform or other relatively solid structure that further includes tunnels, troughs, guide posts, or other mechanical features that can maintain the proper orientation of the fingernails in relation to the scrubbing action. Alternatively, the platform may simply provide friction between the fingers and the platform surface in order to restrain movement. It is also possible for the alignment means to move in some fashion, either in conjunction with or instead of, the motion of the scrubbing means in order to facilitate cleaning under the nails.

For example, the scrubbing means may include a brush that is fixed in place while the finger alignment means may comprise a platform that is able to slide back and forth in front of the brush bristles. The back and forth motion of the alignment platform may be motor driven or driven manually by the user. This configuration also provides proper alignment between the fingernails being cleaned and the scrubbing means exemplified in this example as a brush. Alternatively, the alignment platform may remain fixed, while allowing the fingers to slide back and forth over the platform surface to effect the scrubbing action.

The scrubbing means will preferably be used in connection with some kind of solvent or cleaning solution that is able to assist in lifting and removing dirt and other foreign debris from under the fingernails. In a preferred embodiment, the cleaning solution will comprise a mixture of water and a detergent, soap or other appropriate surfactant. Such aqueous solutions are able to dissolve, or at least loosen, oils and other organic materials associated with many forms of foreign debris commonly found under the nails. Of course, it is certainly within the scope of the invention to use a solvent or mixture of solvents which can be formulated to remove a particular type of foreign debris, such as grease, oily dirt, paint, glue and other foreign debris that are typically not easily removed by soapy water. Nevertheless, the well-focused scrubbing action of the inventive apparatus may allow for the use of cleaning solvents or solutions that are much less harsh than what would be required using manually held cleaning brushes or other apparatus. In some cases, water alone may suffice in removing many kinds of dirt.

In short, it is an object of the invention to provide apparatus and methods for cleaning the gaps under a persons fingernails that alleviate the difficulties associated with manual scrubbing.

It is a further object and feature to provide apparatus and methods for cleaning fingernails that provide a more precise and well-focused scrubbing action compared to manual brushes.

An additional object is to provide apparatus and methods that allow one to obtain clean under the fingernails in a far shorter time frame compared to manual procedures.

It is a further object to provide apparatus and methods that allow for fast and reliable cleaning of the gap under one's fingernails while minimizing effort and concentration on the part of the user.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

A. General Description of Cleaning Apparatus.

The present invention relates to apparatus and systems for cleaning underneath a person's fingernails. The inventive apparatus includes brushes or other scrubbing means that are able to mechanically scrub dirt and other foreign materials from within the gap underneath a person's fingernails. The system further includes a cleaning liquid or solution that is used in combination with the cleaning apparatus. A finger alignment guide or alignment means maintains the fingers in a desired orientation relative to the geometry of motion of the brush bristles or other cleaning means in order for the cleaning action to remain reliably focused at the gap between the fingernail and finger where foreign debris tend to accumulate. This allows for greater ease and comfort with far less concentration and frustration when cleaning under the fingernails compared to manually held brushes or pocket knives used to clean under the nails.

Figure 1A:
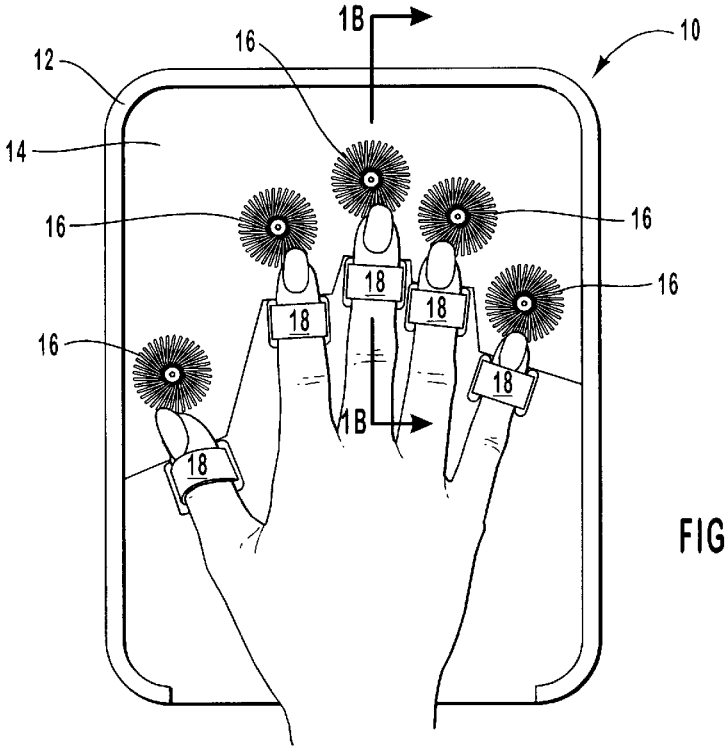
FIG. 1A is a top view of an apparatus for cleaning under a person's fingernails according to the invention.
Figure 1B:
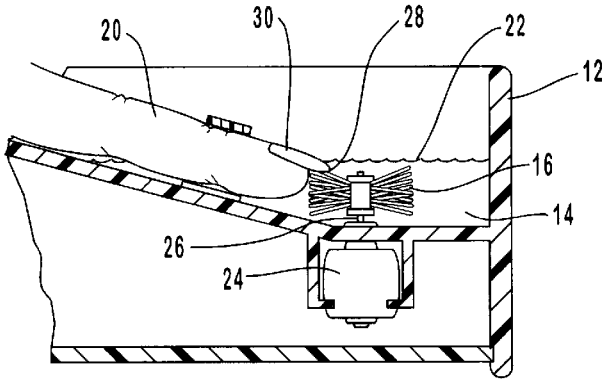
FIG. 1B is a side view of the cleaning apparatus depicted in FIG. 1A.

FIGS. 1A and 1B depict an exemplary cleaning apparatus according to the present invention. More particularly, cleaning apparatus 10 includes a main body 12 that houses or otherwise provides a desired spacial arrangement of the various components of the apparatus, including the scrubbing means and the finger alignment means. Within main body 12 is depicted a cleaning liquid reservoir 14 that holds therein a desired quantity of a cleaning liquid or solution. Submerged within the cleaning liquid reservoir 14 are a plurality of circular brushes 16 comprising scrubbing means and corresponding to each of the fingers being cleaned. In this embodiment, every finger and the thumb can be simultaneously 22 cleaned by the corresponding circular brushes 16. Each finger and the thumb is maintained in a desired alignment relative to the circular brushes 16 by means of corresponding alignment tunnels 18 through which the fingers and thumb are inserted.

Figure 1C:
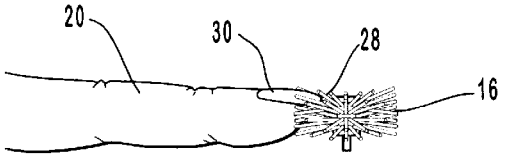
FIG. 1C is a close-up view of FIG. 1B showing more particularly how the brush bristles are able to enter the gap underneath the fingernail.

FIG. 1B more clearly depicts the tip of a finger 20 submerged within the cleaning liquid reservoir 14 and bathed or engulfed within a cleaning liquid 22. The circular brush 16 is able to rotate or oscillate by virtue of being attached to a motor 24 by means of drive shaft 26, which together comprise motorized drive means. As the motor 24 causes the brush 16 to turn or oscillate relative to the tip of finger 20, the tips of brush bristles 28 are able to reach within the gap under fingernail 30 of finger 20. FIG. 1C more clearly depicts how the brush bristles 28 are able to reach within the gap under fingernail 30 and sweep dirt and other debris therefrom.

In order to more fully define the subcomponents of the various cleaning apparatus within the scope of the present invention, a more detailed description of the different subcomponents will now be given.

B. Scrubbing Means.

Figure 2A:
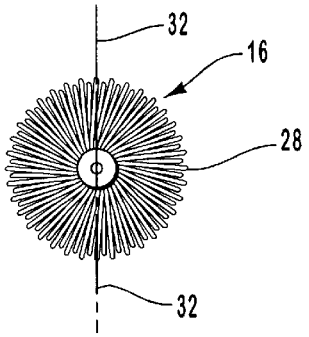
FIG. 2A depicts a substantially circular brush that rotates or oscillates around a central axis.

In a preferred embodiment, the scrubbing means will comprise some type of brush or brush-like configuration of bristles or like mechanical features which are able to mechanically reach under the fingernails in order to effect a scrubbing action. Circular brushes 16 are depicted in FIGS. 1A–1C as well as FIG. 2A. The advantage of having the cleaning bristles 28 attached so as to form circular brush 16 is that this configuration allows for easy rotation or oscillation of the circular cleaning brush 16 about an axis 32 and it provides a well defined plane of scrubbing action using simple drive means, such as motor 24 (FIG. 1B).

Figure 2B:
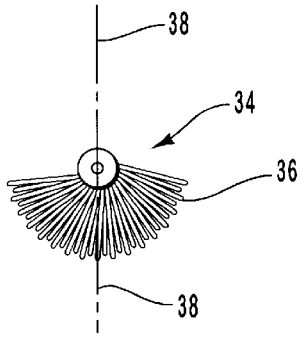
FIG. 2B depicts a semi-circular brush that oscillates around a central axis.

FIG. 2B depicts a variation of a circular brush, which is a semi-circular brush 34, shown in this example to have an radial arc of bristles 36 of approximately 180°. In the case of a semi-circular brush. the brush will preferably oscillate back and forth about an axis 38 rather than being turned continuously in a single direction. It should be understood that any appropriate arc of bristles 36 that allows the bristles 36 to effectively clean under a person's fingernails is within the scope of the invention. Thus, the radial arc of bristles 36 in a semi-circular brush can either be as small as few degrees (e.g., 5°), can approach 360°, or can have any radial angle in between.

Figure 2C:
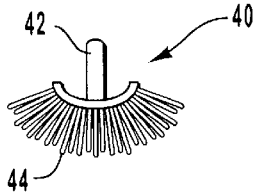
FIG. 2C depicts a convex brush attached to an extension rod.

FIG. 2C depicts a convex brush 40 attached to an extension rod 42, which in turn would be connected to some kind of drive means (not shown) for causing convex brush 40 to oscillate back and forth. Due to the curved nature of convex brush 40. the motion defined by the convex brush 40 will preferably be defined by an arc. An arc-like motion would most reliably urge and retain the bristle tips 44 of convex brush 40 more closely into the gap underneath the fingernails (not shown).

Figure 2D:
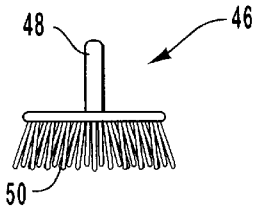
FIG. 2D depicts a straight brush attached to an extension rod.

A straight brush 46 attached to an extension rod 48 is illustrated in FIG. 2D). In use, extension rod 48 may be connected to a drive means (not shown) for causing straight brush 46 to oscillate back and forth. Because the bristles 50 of straight brush 46 terminate in an approximate straight line, the motion defined by the straight brush 46 will preferably define a straight line or rectangle. This motion will reliably urge and retain the bristle tips of straight brush 46 more closely into the gap underneath the fingernails (not shown).

Figure 2E:
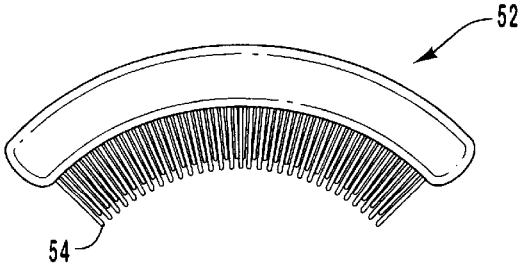
FIG. 2E depicts a concave brush designed to clean more than one fingernail at a time.

FIG. 2E illustrates a concave brush 52 that has bristles 54 oriented so as to form a concave bristle pattern. This bristle pattern more closely correlates to and complements the normal curvature of the fingernails in order to better maintain contact between the bristles 54 and the gap under the nails (not shown). A plurality of concave brushes 52 may be provided which correspond to each finger. Alternatively, the concave brush 52 may be sized so as to scrub more than one, or even all, of a person's fingers.

Notwithstanding the foregoing, any of the brushes depicted in FIGS. 1A through 2E could be driven by drive means to have more complex scrubbing motions in order to optimize the scrubbing action within a specific cleaning apparatus according to the invention. Alternatively, any of the brushes may be substantially fixed such that the scrubbing action is instead provided by movement of the hand and/or fingertips rather than the brush.

Figure 3:
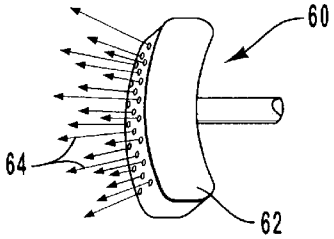
FIG. 3 depicts a water-jet scrubber according to the invention.

Instead of brushes and the like, the scrubbing means may alternatively comprise a water brush 60 as illustrated in FIG. 3. Water brush 60 includes a plurality of openings 62 through which individual water streams 64 are forced under pressure. By directing the water streams 64 within the gap under a person's fingernails (not shown), the water brush 60 is able to dislodge dirt and other debris much like a convention brush. The water streams 64 are preferably emitted in a series of pulses or bursts in order to maximize the scrubbing action of the water streams 64. The water streams 64 may remain stationary relative to the person's fingers, or they may be caused to oscillate back and forth like an ordinary brush in order to further randomize the scrubbing action so as to more effectively remove debris from the entire gap area under the fingernail.

The water streams 64 may comprise water, either at room temperature or at other appropriate temperatures. Heating water greatly increases its solvating action relative to many forms of dirt and debris. The water streams 64 may include any number of aqueous or other solvent-based cleaning solutions in order to target specific kinds of dirt and debris. Once the dirt has been removed, the openings 62 within water brush 60 may optionally emit jets of air, preferably heated air, in order to assist in drying the person's fingertips.

Figure 4A:
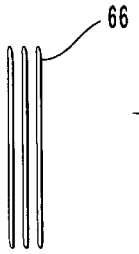
FIG. 4A depicts strand-like scrubbing means oriented in a straight line.
Figure 4B:
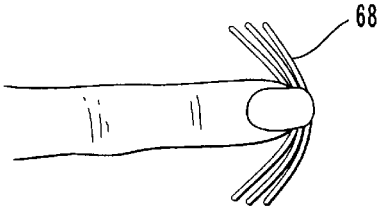
FIG. 4B depicts strand-like scrubbing means oriented in a concave arc.

In yet another embodiment, the scrubbing means may include one or more cleaning strands that are caused to oscillate generally perpendicular to the fingertip. FIG. 4A depicts a plurality of cleaning strands 66 oriented in a generally parallel fashion and in a generally straight line, while FIG. 4B depicts cleaning strands 66 that are oriented in a generally concave orientation relative to the shape of a fingernail, such as what might occur when the parallel strands 66 of FIG. 4A are placed in contact with a fingertip for purposes of cleaning under the fingernail. In that case, the oscillating action will generally follow a concave arc as depicted in FIG. 4B rather than a straight line.

The cleaning strands may comprise any reasonably durable thread, string or other fibrous or fiber-like substance. The cleaning strands will preferably be somewhat rough and irregular in order to provide adequate friction so as to impart a scrubbing action when being oscillated. Like mechanical brushes, the cleaning strands will preferably perform their scrubbing action in combination with some kind of cleaning fluid, be it aqueous or based on another solvent. The strands my also be impregnated with rosins or other tackifying agents that can assist in attracting dirt and other debris to the cleaning strands.

C. Alignment Means.

An important advantage of the inventive cleaning apparatus compared to manually operated cleaning brushes is the inclusion of finger alignment means for maintaining a desired spacial orientation between a person's fingertips and the scrubbing means. Without such alignment means it would be more difficult and would require greater effort and concentration to keep the scrubbing action focused where it is needed. More often hand held brushes often slip off or away from the fingertips, thereby requiring constant readjustment of the brush relative to the person's fingers. Thus, cleaning under one's fingernails can often be a frustrating experience. As will be seen, the alignment means provide for maximum cleaning in a minimum amount of time. Of equal or greater importance, the finger alignment means greatly reduces the effort and concentration required to otherwise keep the fingers and brushing action properly aligned. This also reduces or eliminates frustration.

The finger alignment means may comprise any mechanism by which the fingers are maintained in a proper orientation relative to the cleaning action of the scrubbing means. In general, the motion of the bristles or other scrubbing means will preferably define a plane or some other appropriate geometric shape or pattern depending on the exact motion of the bristles. Maximum cleaning action will occur when the fingernail being cleaned by a particular brush or scrubbing means is substantially coplanar or at least substantially aligned with the plane of the scrubbing action. In this way, the tips of the bristles or other scrubbing means can most easily reach under the person's fingernails and into the gap. Of course, varying degrees of cleaning may still occur within a range of angles above or below exact alignment of the fingernail plane with the scrubbing plane. The present invention includes any orientation of the fingers relative to the scrubbing action that nevertheless allows adequate access of the bristles or other scrubbing means within the gap under the fingernail in order to effect adequate removal of dirt and debris therefrom.

By way of example, the finger alignment means may comprise a finger support platform or other relatively solid structure that further includes tunnels, troughs, alignment posts, or other mechanical features that can adequately maintain proper orientation of the fingernails in relation to the motion of the scrubbing action. The platform may simply provide friction between the fingers and the platform surface in order to restrain or limit movement. It is also possible for the alignment means to move in some fashion, either in conjunction with or instead of, the motion of the scrubbing means in order to facilitate cleaning under the nails. Finally, both the alignment means and scrubbing means may remain substantially stationary while allowing for controlled movement of the person's hand to effect the scrubbing action.

Figure 5A:
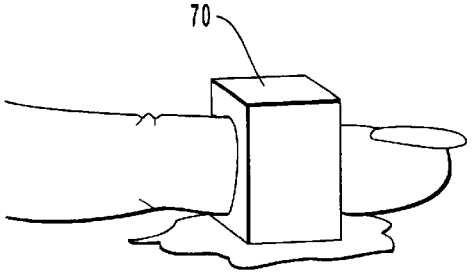
FIG. 5A is a side view of a finger alignment tunnel according to the invention.
Figure 5B:
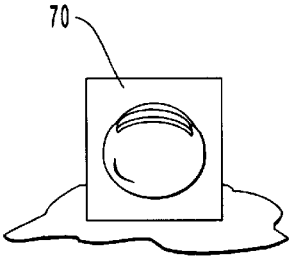
FIG. 5B is a frontal view of the finger alignment tunnel of FIG. 5A.

FIGS. 5A and 5B depict a finger alignment tunnel 70 through which a finger may be inserted in order to maintain the finger in a desired spacial orientation relative to corresponding scrubbing means (not shown). An advantage of finger alignment tunnel 70 is that it can restrain lateral movement of the finger in every direction, both side-to-side and up-and-down motion with virtually no pressure or force being exerted by the user. Axial movement may be restrained by frictional forces between the person's finger and the inner surfaces of the finger guide tunnel 70 as well as by other forces, such as axial force applied by the user or friction between the finger and other portions of the cleaning apparatus. If the platform (not shown) to which the finger guide tunnel 70 is attached is moveable, then the finger guide tunnel 70 can limit or direct movement of the finger relative to the platform. A plurality of guide tunnels can work together to keep the fingers properly spaced apart in a desired orientation.

Figure 6A:
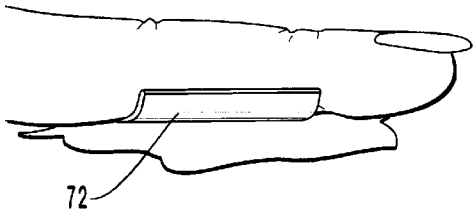
FIG. 6A is a side view of a finger alignment trough.
Figure 6B:
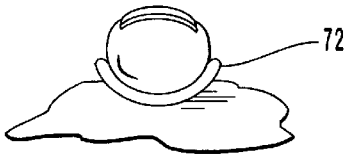
FIG. 6B is a frontal view of the finger alignment trough of FIG. 6A.

FIGS. 6A and 6B alternatively depict a finger alignment trough 72 into which a finger may be placed in order to restrain or limit movement of the finger during the scrubbing action. An advantage of the finger alignment trough 72 is the ease with which one or more fingers may be placed into or withdrawn from the trough(s) 72. Side-to-side motion of a finger is restrained by the inner walls of finger alignment trough 72, while downward motion is limited by the underlying surface of the finger alignment trough 72. The exertion of gentle downward pressure by the user limits substantial upward motion of the finger during the scrubbing action. The platform to which finger alignment trough 72 is formed may itself be either moveable or stationary.

Figure 7A:
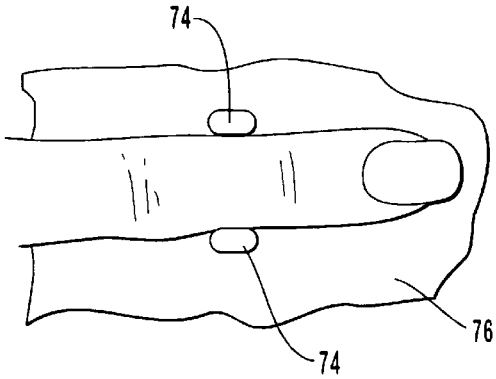
FIG. 7A is a side view of a pair of finger alignment stops.
Figure 7B:
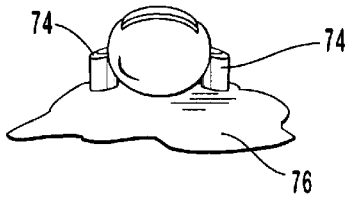
FIG. 7B is a frontal view of the pair of finger alignment stops of FIG. 7A.

FIGS. 7A and 7B depict a pair of finger alignment stops 74 attached to an underlying surface 76 between which a finger can be placed in order to restrain movement of the finger during the scrubbing action. As with the finger alignment trough 72, an advantage of the finger alignment stops 74 is the ease with which one or more fingers may be placed between or withdrawn from between the alignment stops 74. Side-to-side motion of a finger is restrained by the inner walls of finger alignment stops 74, while downward motion is prevented by the underlying surface 76 to which the stops 74 are attached. The exertion of gentle downward pressure by the user limits substantial upward motion of the finger during the scrubbing action. The underlying surface 76 may be either moveable or stationary.

The finger alignment tunnel 70, finger alignment trough 72, and finger alignment stops 74 comprise restraint means for restraining movement of the finger relative to a finger support platform or other structure to which the restrain means are attached. Any structure that can restrain one or more fingers relative to a finger support platform or other structure to which the restraint means may be attached shall comprise restraint means within the scope of the invention.

Figure 8A:
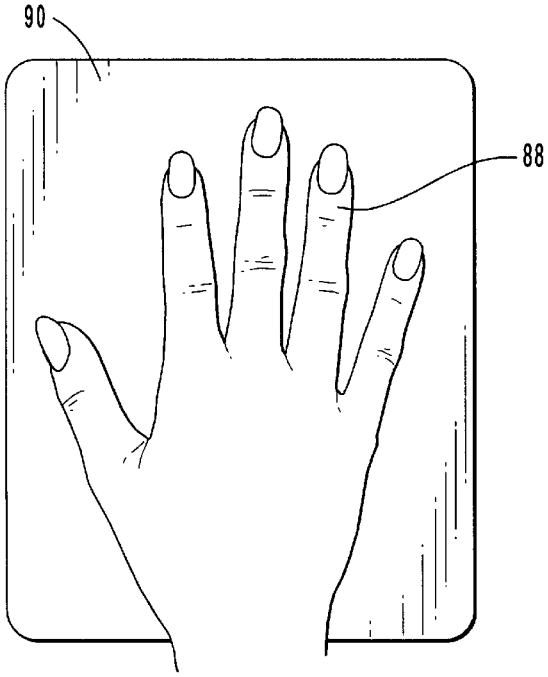
FIG. 8A is a side view of an alignment surface without any definitive mechanical features for restraining finger movement other than friction.
Figure 8B:
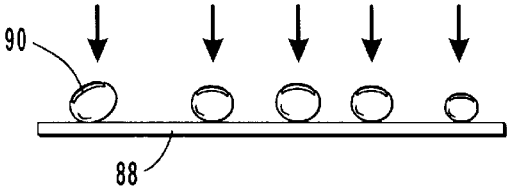
FIG. 8B is a frontal view of the alignment surface of FIG. 8A.
Figure 8C:
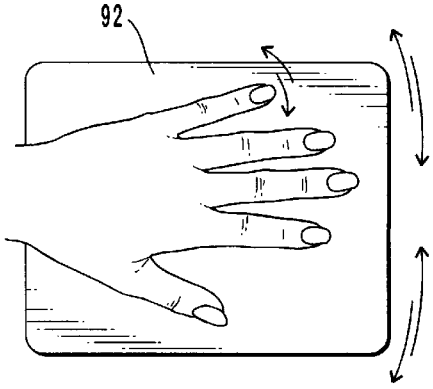
FIG. 8C is a top view illustrating an alignment surface able to oscillate back and forth.

FIGS. 8A–8C depict a finger alignment platform 88 that does not include any mechanical features other than a generally planar, curved or otherwise regular surface. Instead, the surface of finger alignment platform 88, in combination with sufficient downward pressure exerted by the user, is able to generate sufficient static friction so as to adequately restrain relative movement of the person's fingers and the finger alignment platform. In a preferred embodiment, finger alignment platform 88 may have a somewhat roughened surface, at least in appropriate locations, in order to increase the friction between the person's fingers and the finger alignment platform 88. Rosins or other tackifying agents may also be employed if desired to increase friction. The frictional forces, together with sufficient downward pressure, are able to restrain the motion of the person's fingers 90 relative to the finger alignment platform 88, both in a lateral as well as an axial direction relative to the fingers axis. The finger alignment platform 88 may either be moveable or stationary.

FIG. 8C depicts a modified finger alignment platform 92 that is able to oscillate in a side-to-side or arc-like motion in order to provide desired movement between the finger alignment platform 92 and the scrubbing means (not shown). In this manner, the scrubbing action may be enhanced or even subsumed by the oscillating action of the finger alignment platform 92. Alternatively the finger alignment platform 92 may be sufficiently slick so as to permit the fingers to slide back and forth across the platform surface. In this manner, the platform is able to properly orient the person's fingernails relative to appropriate scrubbing means such as a stationary brush (not shown), in order to maximize the scrubbing and cleaning action under the fingernails.

Figure 9:
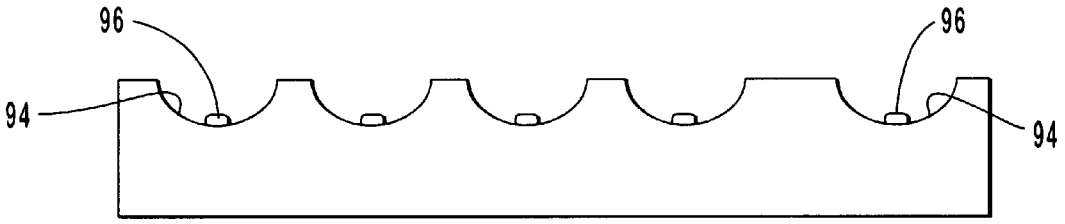
FIG. 9 is a frontal view depicting a set of four activation switches within corresponding finger alignment troughs for activating the corresponding scrubbing means when fingers are placed within the alignment troughs.

FIG. 9 depicts a set of modified finger alignment troughs 94 that further include a plurality of corresponding activation buttons 96. Placement of a finger in each of the corresponding troughs 94 causes a corresponding activation button 96 to be depressed. This, in turn, causes corresponding scrubbing means (not shown) to become activated by means of drive means (not shown). By this manner, the cleaning apparatus can automatically turn on and off depending on whether or not one or more fingers have been placed into a position that would allow for the scrubbing and cleaning of the gap under the fingernail. Of course, the activation means may include any switching means known in the art and is not limited by the particular activation means depicted in FIG. 9.

Figure 10:
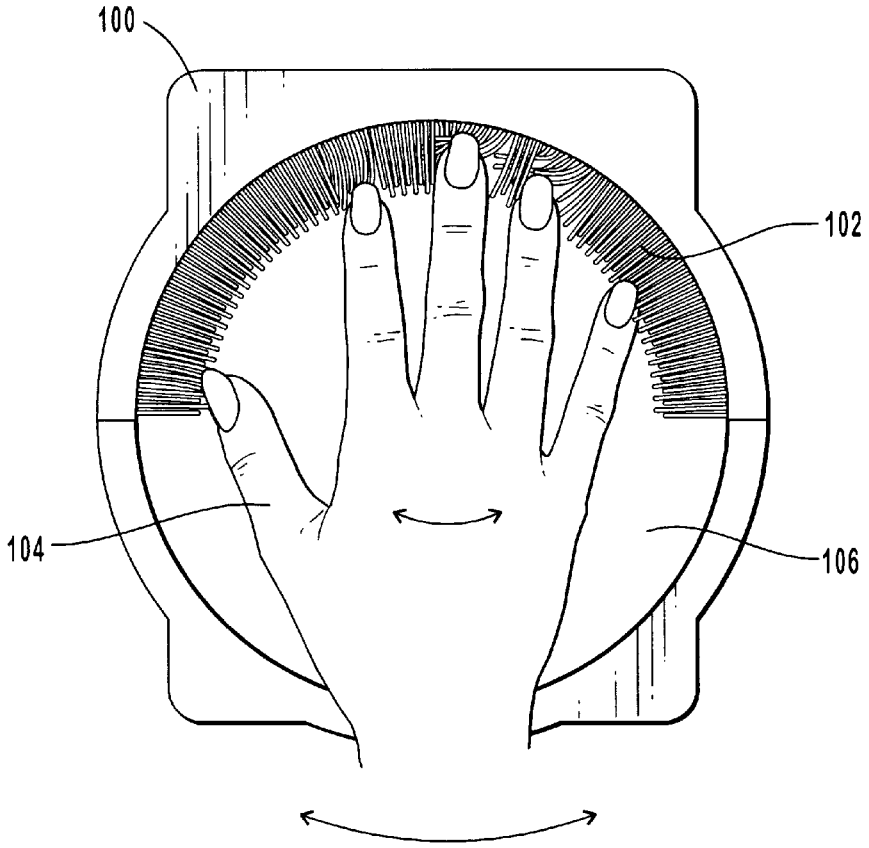
FIG. 10 illustrates an alternative cleaning apparatus having a stationary concave brush and a moveable or stationary finger alignment guide.

FIG. 10 depicts an alternative embodiment of cleaning apparatus according to the present invention. More particularly, FIG. 10 depicts a manually powered cleaning apparatus 100 that includes substantially fixed cleaning bristles 102. A person's hand 104 sits on top of a finger guide platform 106 which may or may not be equipped with auxiliary finger alignment structures such as tunnels, troughs, guide posts, and one or more areas of increased friction. In a first embodiment, the finger alignment platform 106 is able to move back and forth in response to movement by the user's hand in order to allow the fingers to move in relation to the cleaning bristles 102. In this way, the force required to effect the scrubbing action is provided by the user's hand and facilitated by movement by the finger alignment platform 106. The alignment platform 106 may be allowed to oscillate from side-to-side using any system or configuration of tracks, bearings, pulleys, wires, and the like known in the art.

In an alternative embodiment, the finger alignment platform 106 can remain stationary in a desired orientation relative to the cleaning bristles 102. The surface of the finger alignment platform 106 may be sufficiently smooth or devoid of friction so as to allow movement of the user's fingers relative to the alignment platform 106. This allows the user to move his or her hand from side-to-side in order to effect a scrubbing action in relation to the cleaning bristles 102. The utility of the finger alignment platform 106 is evidenced by the ability of the user to exert significant scrubbing force while maintaining the fingers in the proper alignment relative to the cleaning bristles 102. Increased lubrication between the user's fingers and the finger alignment platform 106 may be provided by soapy water or other cleaning fluids that can cause the alignment surface 106 to become more slippery.

D. Cleaning Liquids.

The scrubbing means will preferably be used in connection with some kind of solvent or cleaning solution that is able to assist in lifting and removing dirt and other foreign debris from under the fingernails. In a preferred embodiment, the cleaning solution will comprise a mixture of water and a detergent, soap or other appropriate surfactant. Such aqueous solutions are able to dissolve, or at least loosen, oils and other organic materials associated with many forms of foreign debris commonly found under the nails. Of course, it is certainly within the scope of the invention to use a solvent or mixture of solvents which can be formulated to remove a particular type of foreign debris, such as grease, oily dirt, paint, glue and other foreign debris that are typically not easily removed by soapy water. Nevertheless, the well-focused scrubbing action of the inventive apparatus will typically allow for the use of cleaning solvents or solutions that are more gentle and much less harsh than what would be required using manually held cleaning brushes or other apparatus. In some cases, water alone may suffice in removing many kinds of dirt, particularly heated water.

Virtually any known cleaning solution, whether aqueous or based on other solvents may be used in combination or in conjunction with the cleaning apparatus of the present invention. The only criteria is that the cleaning solutions are preferably not unduly harsh so as to overly irritate or damage the person's skin and fingernails. Of course, in the case of particularly hard-to-remove dirt, chemicals, grease, paint, varnish or other more durable debris, a certain amount of chemical harshness may be necessary in order to successfully dislodge the foreign matter from under the person's fingernails. Antibacterial washes may be employed as well to assist in disinfecting a person's fingertips and under the fingernails (e.g, in the medical field).

E. Summary.

The present invention provides apparatus and methods for cleaning the gaps under a persons fingernails that alleviate the difficulties associated with manual scrubbing.

The invention further provides apparatus and methods for cleaning fingernails that provide a more precise and well-focused scrubbing action compared to manual brushes.

In addition, the invention provides apparatus and methods that allow one to obtain clean under the fingernails in a far shorter time frame compared to manual procedures.

The invention further provides apparatus and methods that allow for fast and reliable cleaning of the gap under one's fingernails while minimizing effort and concentration on the part of the user.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A cleaning apparatus for cleaning the gap under at least one of a person's fingernails comprising:

scrubbing means for removing foreign debris from the gap under at least one fingernail, said scrubbing means including at least one scrubbing component selected from the group consisting of bristles and strands which are configured so as to be capable of entering the gap under the at least one fingernail in order to remove foreign debris therefrom; and finger alignment means for maintaining at least one fingernail in an orientation so as to facilitate entry of at least a portion of the scrubbing means into the gap under the at least one fingernail.

2. A cleaning apparatus as defined in claim 1, wherein the finger alignment means includes at least one finger alignment guide selected from the group consisting of finger alignment tunnel, finger alignment trough, and finger alignment stops.

3. A cleaning apparatus as defined in claim 1, wherein the finger alignment means includes a substantially regular surface selected from the group consisting of planar and curved surfaces.

4. A cleaning apparatus as defined in claim 3, wherein desired alignment and restraint of movement between at least one finger and the scrubbing means is maintained by means of friction between the substantially regular surface and the at least one finger.

5. A cleaning apparatus as defined in claim 3, wherein the substantially regular surface is substantially devoid of friction so as to permit slippage and movement of at least one finger relative to the substantially regular surface.

6. A cleaning apparatus as defined in claim 1, wherein the scrubbing means comprises a brush that includes bristles, wherein at least some of the bristles are able to enter into the gap under the at least one fingernail in order to mechanically remove foreign debris therefrom.

7. A cleaning apparatus as defined in claim 6, wherein the bristles include bristle tips that define a curve.

8. A cleaning apparatus as defined in claim 6, wherein the bristle include bristle tips that define a substantially straight edge.

9. A cleaning apparatus as defined in claim 1, wherein the scrubbing means further includes a liquid brush capable of emitting a stream of liquid with sufficient force so as to remove foreign debris from the gap under a person's fingernails.

10. A cleaning apparatus as defined in claim 1, wherein the scrubbing means comprises one or more cleaning strands.

11. A cleaning apparatus as defined in claim 1, further including drive means for causing relative movement between the scrubbing means and the at least one fingernail being cleaned.

12. A cleaning apparatus as defined in claim 11, wherein the at least one fingernail remains substantially stationary and wherein the drive means causes the scrubbing means to move in relation to the at least one fingernail.

13. A cleaning apparatus as defined in claim 11, wherein the scrubbing means remain substantially stationary and wherein the drive means causes the finger alignment means to move relative to the scrubbing means so as to result in a scrubbing action that cleans debris from the gap under the at least one fingernail.

14. A cleaning apparatus as defined in claim 11, further including activation means for activating the drive means.

15. A cleaning apparatus as defined in claim 1, wherein manual movement of the at least one fingernail relative to the scrubbing means facilitates removal of debris from the gap under at least one fingernail.

16. A cleaning apparatus as defined in claim 1, further including a cleaning liquid that assists the scrubbing means in removing debris from under the at least one fingernail.

17. A cleaning apparatus as defined in claim 16, wherein the cleaning liquid is antipathogenic and able to substantially sterilize the at least one fingernail and surrounding finger tissues.

18. A cleaning apparatus for cleaning the gap under at least one of a person's fingernails comprising:

at least one brush that remains substantially stationary during cleaning of one or more fingernails; and a finger alignment guide which allows at least one finger to move relative to the scrubbing means so as to facilitate entry of at least a portion of the brush into the gap under the at least one fingernail in order to effect cleaning of the gap under the fingernail.

19. A cleaning apparatus as defined in claim 18, wherein the finger alignment guide is configured so as to prevent substantial slippage between at least one finger and the finger alignment guide, wherein the finger alignment means and the at least one finger move together relative to the brush.

20. A cleaning apparatus as defined in claim 18, wherein the finger alignment guide is configured to be substantially stationary in relation to the brush, wherein the finger alignment guide is sufficiently devoid of friction so as to permit slippage and movement of at least one finger relative to the finger alignment guide, thereby allowing at least one finger to move relative to the brush in order to effect cleaning of the gap under the fingernail.

21. A cleaning apparatus as defined in claim 18, further including a cleaning liquid that assists the brush in removing debris from under the at least one fingernail.

22. A cleaning apparatus as defined in claim 18, wherein the cleaning apparatus includes one single brush that is able to clean the gap under a plurality of fingernails.

23. A cleaning system for cleaning the gap under at least one of a person's fingernails comprising:

a finger alignment guide that restrains movement of at least one finger during cleaning of the gap under the fingernail; and at least one brush that is configured so as to move relative to the at least one finger and oriented so as to at least partially enter the gap under the at least one fingernail in order to effect cleaning thereof.

* * * * *

UNITED STATES PATENT AND TRADEMARK OFFICE

CERTIFICATE OF CORRECTION

PATENT NO. : 6,016,812

DATED : Jan. 25, 2000

INVENTOR(S) : John M. Guynn

It is certified that error appears in the above-identified patent and that said Letters Patent is hereby corrected as shown below:

Col. 6, line 11, before "cleaned" delete [22]

Signed and Sealed this

Twenty-seventh Day of March, 2001

*Attest:*

*Attesting Officer*

Nicholas P. Godici

NICHOLAS P. GODICI

*Acting Director of the United States Patent and Trademark Office*

UNITED STATES PATENT AND TRADEMARK OFFICE

CERTIFICATE OF CORRECTION

PATENT NO. : 6,016,812
APPLICATION NO. : 09/205139
DATED : January 25, 2000
INVENTOR(S) : Guynn It is certified that error appears in the above-identified patent and that said Letters Patent is hereby corrected as shown below:

Column 12
Line 62, change “scrubbing means” to --brush--

Column 13
Line 2, change “means” to --guide--

Signed and Sealed this
Twenty-fourth Day of April, 2012

David J. Kappos

David J. Kappos
*Director of the United States Patent and Trademark Office*